US011306902B1

(12) United States Patent
Bennett

(10) Patent No.: US 11,306,902 B1
(45) Date of Patent: Apr. 19, 2022

(54) CAN LIGHT INSTALLATION SYSTEM

(71) Applicant: LaVon Bennett, Mesa, AZ (US)

(72) Inventor: LaVon Bennett, Mesa, AZ (US)

( * ) Notice: Subject to any disclaimer, the term of this patent is extended or adjusted under 35 U.S.C. 154(b) by 0 days.

(21) Appl. No.: 17/212,936

(22) Filed: Mar. 25, 2021

(51) Int. Cl.
*F21V 21/04* (2006.01)

(52) U.S. Cl.
CPC ..... *F21V 21/047* (2013.01)

(58) Field of Classification Search
CPC ..... F21V 21/047; F21V 21/049; F21S 8/026
See application file for complete search history.

(56) References Cited

U.S. PATENT DOCUMENTS 7,667,136 B2 * 2/2010 Dinh ..... H02G 3/123 174/58
2013/0286667 A1 * 10/2013 Sampsell ..... F21V 23/06 362/368
2015/0016096 A1 * 1/2015 Parson ..... B25F 5/02 362/119

FOREIGN PATENT DOCUMENTS

GB 2411053 A * 8/2005 ..... H02G 3/123

* cited by examiner

*Primary Examiner* — Leah Simone Macchiarolo
(74) *Attorney, Agent, or Firm* — Amy Fiene PC

(57) ABSTRACT

A light can or enclosure for a can light fixture that simplifies installation, by incorporating to the can the functions of drilling a hole, and mounting the can.

20 Claims, 12 Drawing Sheets

CAN LIGHT INSTALLATION SYSTEM

BACKGROUND

Lights provide a source of illumination for indoor and outdoor spaces. Recessed lights, or can lights, are recessed lights positioned within ceiling walls so as to be flush with the ceiling.

BRIEF DESCRIPTION OF DRAWINGS

The accompanying drawings illustrate various implementations of the principles described herein and are a part of the specification. The illustrated implementations are merely examples and do not limit the scope of the claims.

Throughout the drawings, identical reference numbers designate similar, but not necessarily identical, elements.

DETAILED DESCRIPTION

Figure 1:
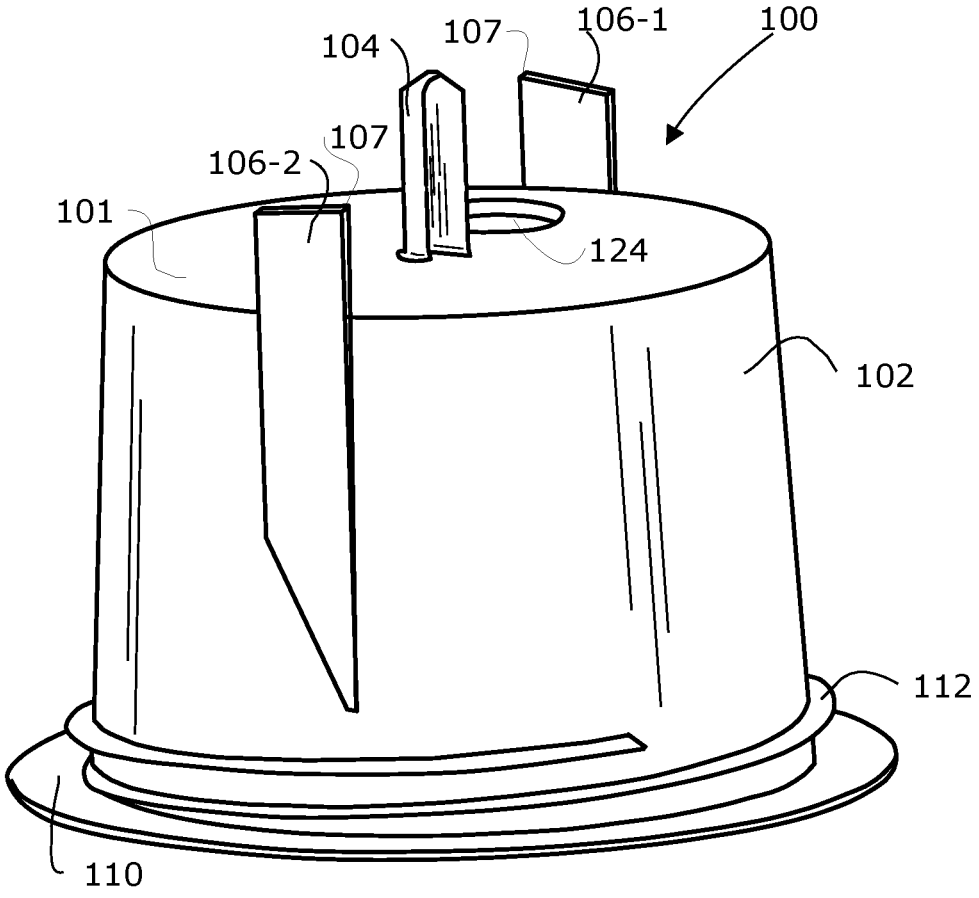
FIG. 1 is a perspective view of a light can according to an example of principles described herein.

A can or recessed light is a light fixture that is installed in an opening on a ceiling. The housing of a light may be cylindrical, metal, and can-like. The appearance of the can light resembles a light bulb installed into an empty can and inserted into a ceiling up into an open hollow space of a ceiling. When installed, can lights present a more or less flush appearance on the ceiling.

While can lights may provide an aesthetically pleasing appearance, they may be difficult to install. Ceilings may be hard to access for installation. Ceilings may also be high or angled or otherwise difficult to drill openings that are made to be the right size. Positioning the placement of the openings may also be an issue. In addition, installation usually requires generation of a large amount of debris from the cutting of the ceiling and removal of any insulation above the installation hole.

The present light can system is suited for installing a can light fixture. The necessity for drilling a hole and then installing a light can and wiring the light can is replaced by the light can described herein with a more simple and efficient process.

A light can is used to drill the hole, and when inserted up into the ceiling functions as the can or housing that receives the lighting fixture. This contrasts with prior-art systems that require a hole be cut in the ceiling. A light metal can or housing is mounted above the hole. The housing has to be firmly mounted, for example, by metal struts attached to a joist or rafter.

This requires access above the ceiling to install the housing and its support parts. An undesirable consequence of all this is that significant debris from the cutting and housing installation falls through the hole, soiling anything in the room below the hole.

In the present system, the light can creates the hole, by rotating the light can with a suitable rotary tool and pushing the light can up against the ceiling, where the light can cuts the hole. At the top end of the light can, a central member or axis pin/cutter starts a small hole, and as the light can rotates around the central member and advances, side members with cutters cut into and through the ceiling, forming a hole or cutout. After forming the hole, the light can is further pushed up through the hole, keeping debris above the ceiling. The light can is then fixed to the ceiling by threads on the exterior of the light can that engage the edges of the hole in the ceiling. Throughout this process, no ceiling access is required. In addition, cutting debris is harmlessly kept up above the ceiling, and not down in the room.

The rotary tool, may be, for example, suitable tools to impart a rotation to the light can, and may be a drill, nut/screw driver, wrench (battery, electric, or manual) with a conventional bit that engages structure on the inside of the light can. In the example below, the bit is a nut-driver that engages a hexagonal boss on the inside of the light can. Alternate bits include, but are not limited to, screw, hexagon structure combinations etc.

The installed light can functions within the ceiling as the housing for the lighting fixture. The interior of the drill can is dimensioned so that a light fixture, as used in recessed lighting, can be inserted up to the lower opening and fixed in the same way as for prior-art housings. Light fixtures conventionally have spring wires or tabs, that bear against the wall of the housing to hold the fixture in place.

Electrical wiring from the lighting fixture is threaded through an aperture in the top of the light can. At this point, ceiling access may be required, to direct and connect the wiring to a suitable power source, or light controller.

In addition, a snorkel-like tube may extend from the aperture above the light can to allow a wire passage to above ceiling insulation.

An exemplary installation may be done with only a light can and a rotary tool with a conventional bit, and a single continuous operation that proceeds as follows;

(1) Hold the light can to the ceiling with the central member or axis pin/drill at the point where a light fixture is desired, (2) Operate the drill with some pressure up against the ceiling so that the drill can starts cutting through the ceiling.

(3) After the light can fully penetrates the ceiling, thereby creating a round cutout hole, continue pressure to push the drill can up into the ceiling.

(4) Operate the drill as threads on the exterior of the light can approach the ceiling so that the turning motion permits threads to engage the edges of the hole and screw the light-can into the hole, and advance the opening of the light can flush with the lower ceiling surface.

Up to this point, only one conventional tool, the drill with an appropriate bit, is required. After installation, the drill bit is removed, and the light fixture can now be inserted, wired, and trim applied, as is described here in in greater detail.

This contrasts with a prior-art installation, where first a suitably dimensioned hole is cut, which may require a large hole saw and a drill motor, but may likely require, depending upon tools available, careful measuring and layout on the ceiling, one or more of a drill motor, drill bit, saw, box cutter, knife, and rasp file. But before the housing is inserted, construction and mounting of a housing strut support above the ceiling is required, probably requiring several more construction tools. The present system replaces this kind of installation with a single continuous operation, requiring only a light can and a means to drive it.

An example light can includes a sleeve having an elongated cylindrical member with rounded outer sidewalls. A hollow is located within the sleeve. Two side members extend co-axially along outer walls of the sleeve. Each side member includes at its upper end a cutting edge for cutting a surface. The two opposing side members are to extend within a structural surface such as a ceiling. The sleeve is to be rotated axially with the edges of the two side members to cut a rounded hole within the structural surface. The sleeve is then to be inserted within the hole. An annular ridge located at a second or lower end of the sleeve stops the sleeve from further insertion of the sleeve within the surface when the sleeve opening comes essentially flush with the ceiling surface.

Another example light can includes a sleeve having an elongate cylindrical member with rounded outer sidewalls. The sleeve includes a hollow therein and a top covering. A central member extends outward from the top covering of the sleeve, the central member having a pointed cutting head, or like structure, to cut into a surface. A plurality of side members extend co-axially along opposing sides of the sleeve and extend beyond a first end of the sleeve. Each side member includes a cutting edge for cutting into a surface when the sleeve is rotated around the central member within the surface so to define a circular cutout portion of the surface and allow the sleeve to be inserted through the material behind the surface. Annular threads at or near a second end of the sleeve engage the material at the edges of the hole or cutout portion to allow a screw fit of the light can within the material behind the surface. An annular ridge at a second end of the sleeve stops the sleeve from further insertion of the sleeve within the surface.

The surface may be the surface of a ceiling, and the material can be the structural material of the ceiling, and may include on or more of plaster, dry wall, gypsum, HardiFlex™, wood, cellulose fiber, cement, and sand.

Another example light can includes a sleeve having an elongate cylindrical member with rounded outer sidewalls and a hollow within the sleeve. A central member extends outward from the sleeve, the central member having a pointed and/or cutting head to cut into a surface. A plurality of side members extend co-axially along opposing sides of the sleeve and extend beyond a first end of the sleeve. Each side member includes a cutting edge for cutting into a surface when the sleeve is rotated within the surface so to define a circular cutout portion of the surface and allow the sleeve to be inserted within a material underneath the surface. Annular threads at or near a second end of the sleeve allow a screw fit of the light can within the material underneath the surface. An annular ridge at a second end of the sleeve stops the sleeve from further insertion of the sleeve within the surface.

Referring to FIGS. 1, 2, 3, 4, and 5, which are perspective views of a light can 100. The light can 100 includes a sleeve 102, two side members 106-1, -2, central member 104, anchor threads 112, and annular flange 110. The sleeve 102 is a cylindrical member with a hollow space therein. In an example, the walls of the sleeve 102 are straight from a bottom to a top of the cylinder. In another example, the walls are slightly tapered inward with slanted walls from a bottom to a top of the cylinder. The light can 100 is used to drill a hole in a ceiling or wall. The light can 100 is received within the hole and attached to the ceiling. A light can may then be inserted within the hollow of the light can 100 and attached to the light can 100.

The central member 104 is an elongated member that extends perpendicularly away from the top 101 of the sleeve 102 along its central axis. The central member 104 is positioned on the center of the top of the sleeve 102. The central member 104 extends a length that is greater than the distance the side members 106-1,-2 extend about the top. As shown, the tip of the central member 104 has a cutting edge to cut or drill into the ceiling, and make an initial pilot hole, or other type of indention or hole in the ceiling, to allow the central member 104 to provide an axis around which the light can rotate for installation.

Side members 106-1, -2 are flattened elongated members that extend from opposite sides of the sleeve 102 and are coaxially aligned with respect to the central axis defined by the central member 104. The side members 106-1, -2 may also be slightly curved to follow the curvature of the outer walls of the sleeve 102. They may also be blade-like or slightly tapered, or otherwise angled, from one side edge to the other side edges. The tops of the side members 106-1, -2 are configured to include cutting edges 107, and may be, for example, flat with sharp edges. In another example, the tops are angled or slightly curved or have other surface features. The tops may include top edges that are jagged or have other surface features for cutting.

The sleeve 102 rotates about its central axis by a rotational force applied to the central member 104. With the rotational motion, the side members 106-1, -2 spin around in a circular motion about the central axis of the sleeve 102. A longitudinal force is also applied to the central member 104 along the central axis, which causes the side members 106-1, -2 to exert both a circular force as well as a longitudinal force against the ceiling. With the rotational force and longitudinal force applied to the central member, side members 106-1, -2 drill a circular hole in the ceiling for the sleeve 102 to be inserted.

The central member 104 extends higher than each of the side members 106-1, -2. This allows the central member 104 to pierce the ceiling and anchor on a rotation axis the light can 100 prior to the side members 106-1, -2 begin to drill a hole in the ceiling.

Figure 4:
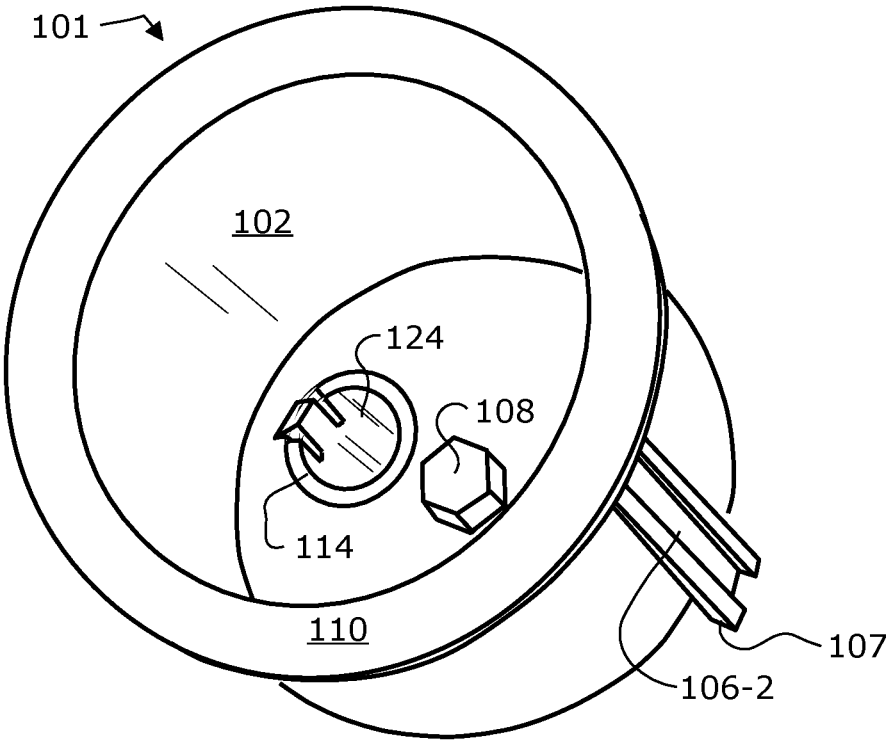
FIG. 4 is a perspective view of a light can, according to an example of principles described herein.

Referring particularly to FIG. 4, which illustrates a perspective view of the interior of the sleeve 102, a boss head 108 is attached to the interior or underside surface of the top 101. The boss head 108 is physically placed on the same axis of the central member 104. Rotation of the boss head 108, which is communicably attached to the central member 104, is the member to which a force is applied to transmit both longitudinal and axial forces to the central member 104. Thus, rotation and force applied to boss 108 applies rotation and force to the central member 104. The boss head 108 includes a hexagon shaped head in which a driver is to be attached, however, other shapes are anticipated. In other examples, the shape is star-shaped, square-shaped, or other shape which can be driven by a conventional driver, such as a screw-driver, nut-driver, hexagon-driver (e.g., allen, etc.), and the like.

FIGS. 1, 2, 3, 4 and 5 illustrate a side opening 124. The side opening 124 is offset to the side from the center of the top 101 of the sleeve 102. The side opening 124 is to provide a space in which wires may be fed for electrically connecting a light can to the ceiling.

Figure 2:
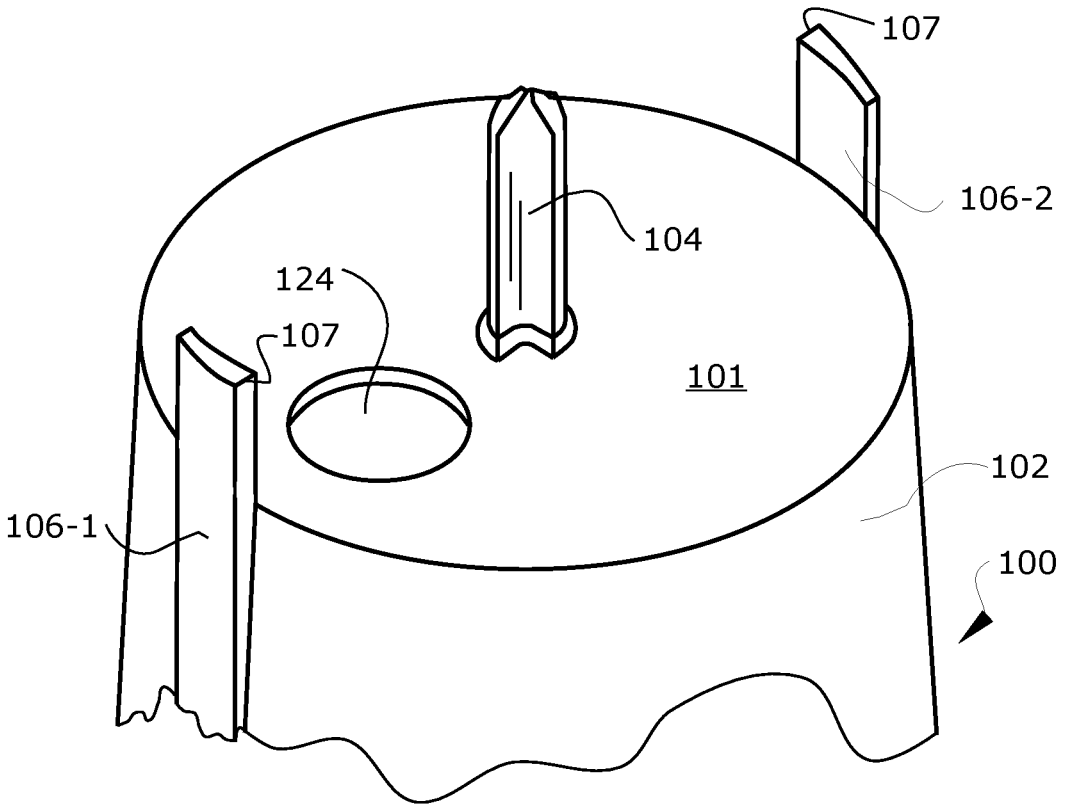
FIG. 2 is a cutout perspective view of a light can according to an example of principles described herein.
Figure 3:
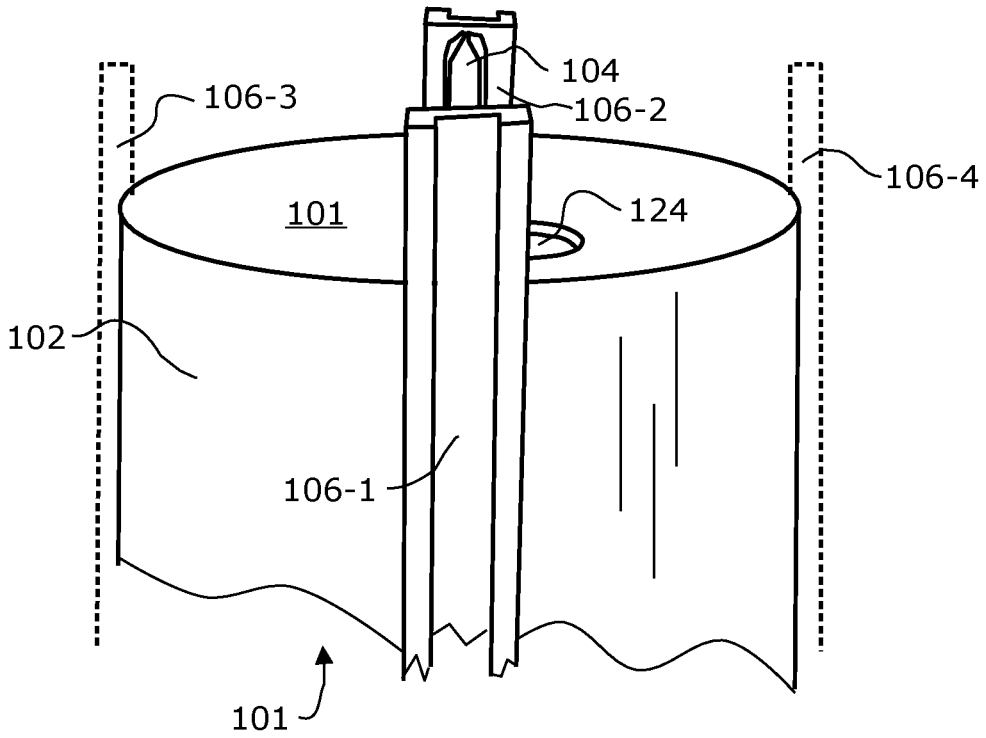
FIG. 3 is a cutout perspective view of a light can according to an example of principles described herein.
Figure 5:
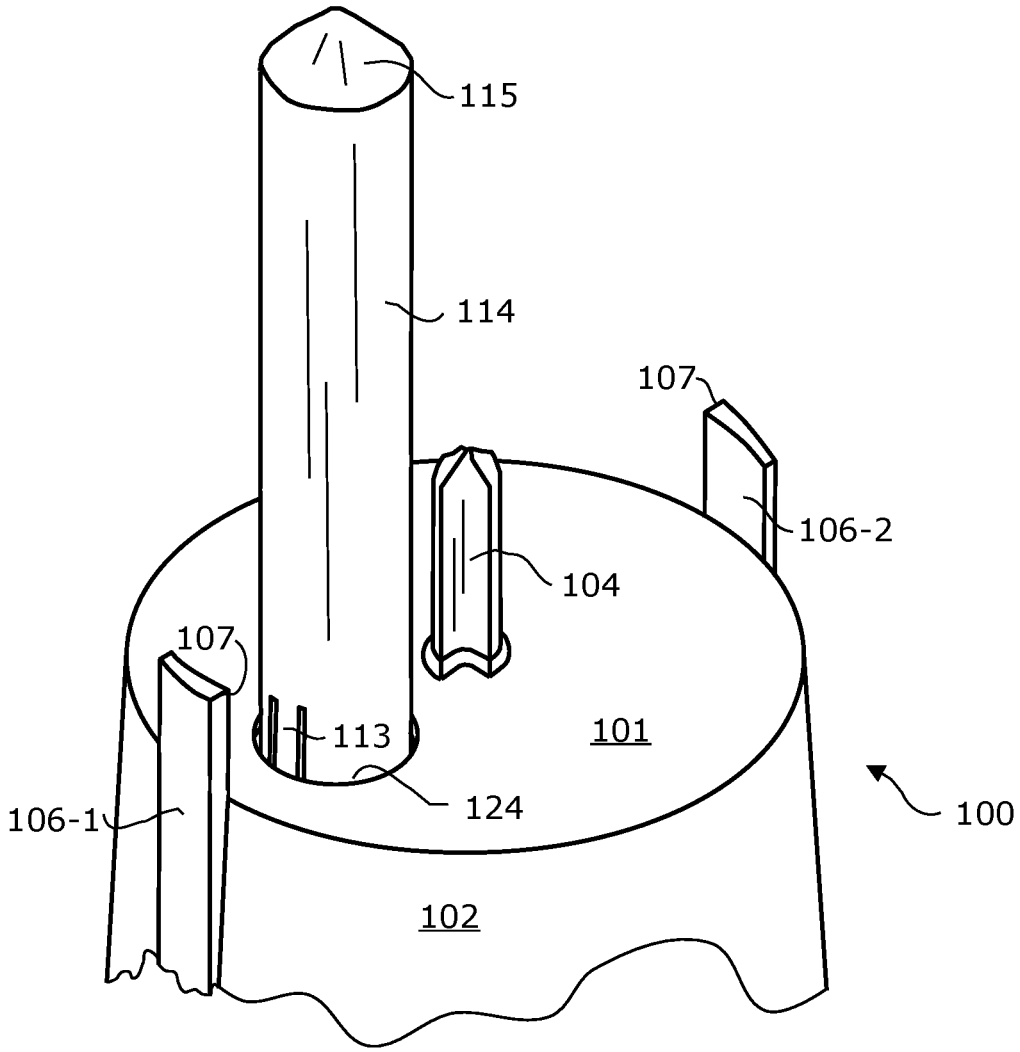
FIG. 5 is a perspective view of a light can, according to an example of principles described herein.

In FIGS. 1, 2, and 5 illustrate the side members 106-1, -2 having tapered and curved sides. They do not mirror each other relative to the sleeve 102, but instead they are positioned with tapered sides following the direction of the curvature of the sleeve 102. As shown, the widest edge is structured as a leading cutting edge 107 and is located on a side that leads a clockwise direction to cut the ceiling in a counter-clockwise rotation. The trailing edge of each side member 106-1, -2 is the narrowest edge. The edges of the side members 106-1, -2 may be beveled or have other end finish. FIGS. 3 and 4 show side members 106-1, and 106-2 with a channeled construction.

In FIGS. 1, 2, 3, 4, and 5, tops of the side members 106-1, -2 are slightly beveled so that the cutting edges 107 contact the ceiling first to initiate cutting of a ceiling hole. Two side members are shown, but a drill can may have any appropriate number of side members, such as, for example, 3 to 4 side members. (See 106-3 and 106-4 in phantom in FIG. 3).

FIG. 5 also shows a snorkel extension 114 inserted into the side opening 124 from below, from inside the light can 100. The snorkel extension 114 can be used as a wire guide, particularly to guide wires to above insulation above the ceiling. The illustrated snorkel extension 114 is generally tubular, comprises a closed pointed or convex end 115 to assist in pushing up through the insulation, and a latch 113 for securing it in the side opening 124. Other configurations are contemplated.

Figure 6:
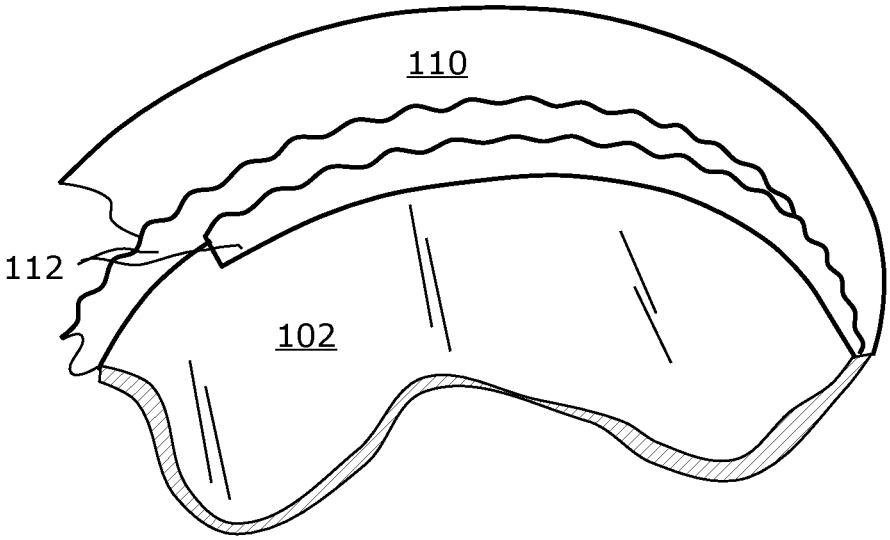
FIG. 6 is a cutout perspective view of a light can, according to an example of principles described herein.

FIG. 6 illustrates a cut out portion of an alternate anchor thread configuration. Shown is an annular ridge 110, anchor threads 112, and sleeve 102. The anchor threads 112 are shown serrated. Any suitable thread configuration is contemplated, including straight, serrated, notched, or saw-toothed. Depending upon ceiling configuration, such may improve cutting and/or holding by the anchor threads.

Figure 7:
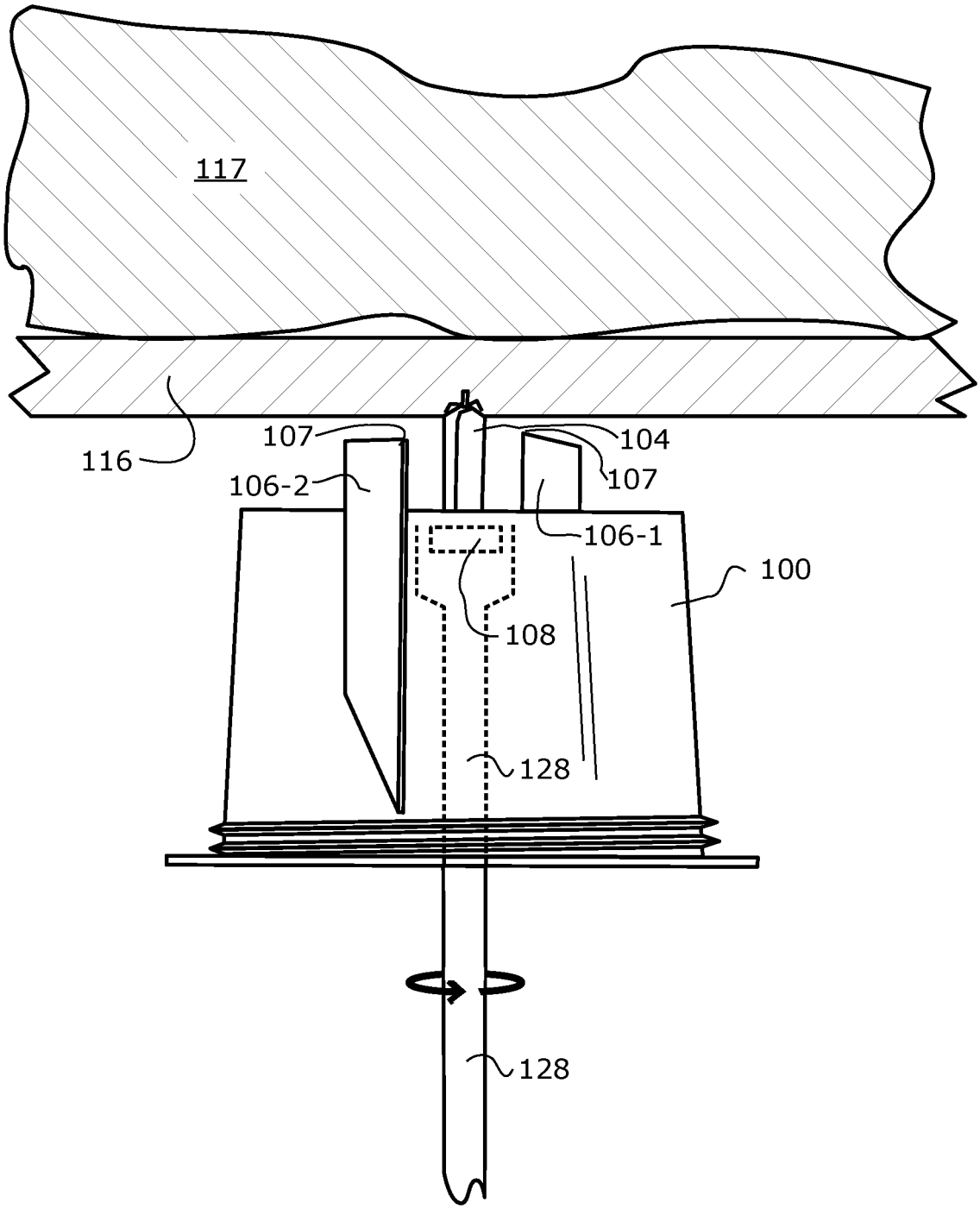
FIG. 7 is a cutout side view of a light can being assembled, according to an example of principles described herein.

FIGS. 7, 8, 9, 10, 11, and 12 illustrate the assembly of the light can 100 to a ceiling 116. FIG. 7 illustrates the initial indention or hole made after the central member 104 pierces the surface of the ceiling 116. A driver 128 as shown in phantom in the interior of the light can 100 engages the boss head 108 (phantom). The driver 128 rotates the boss head 108 which provides both axial and longitudinal force to make the initial indention or hole.

Figure 8:
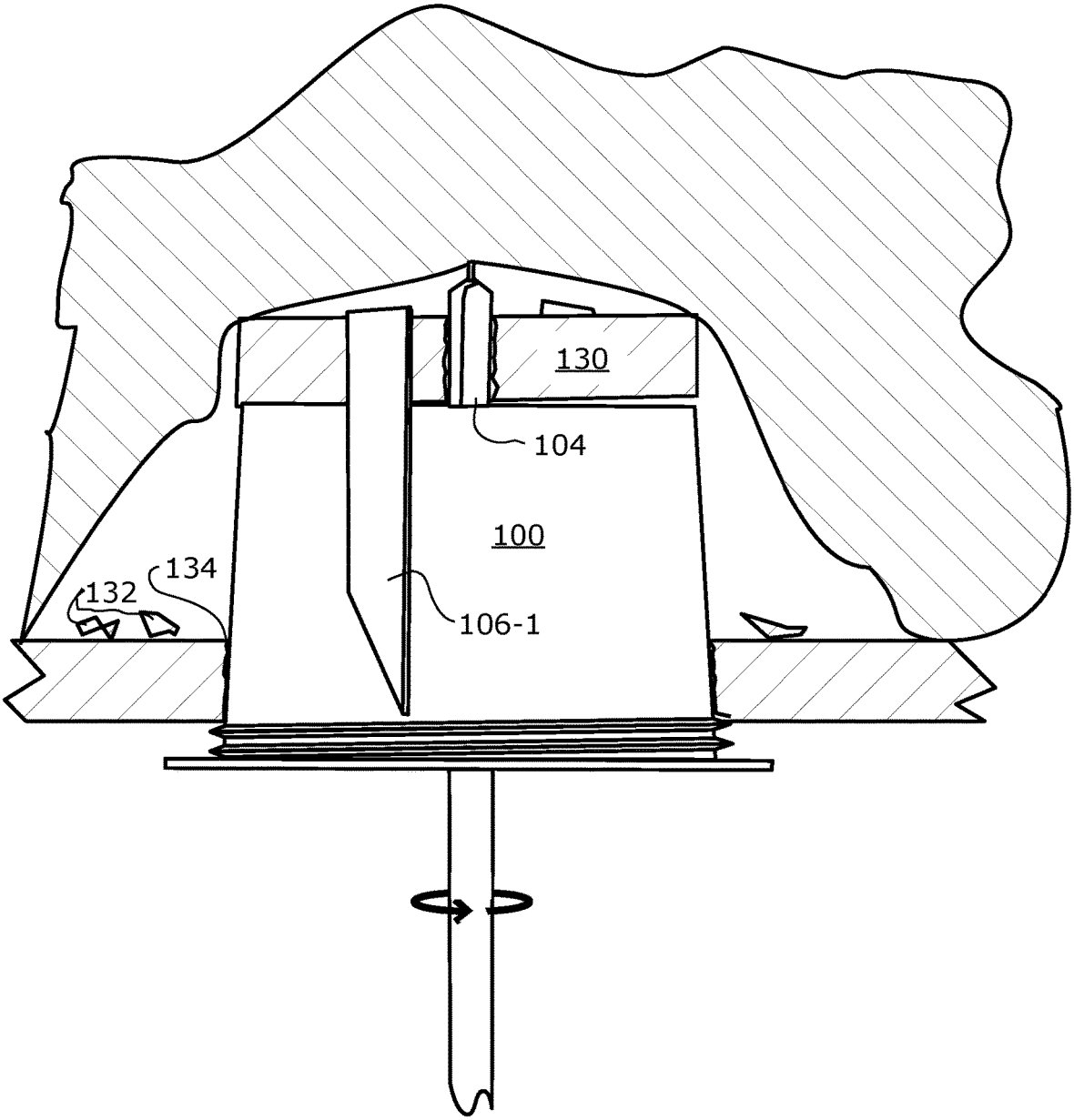
FIG. 8 is a cutout side view of a light can being assembled, according to an example of principles described herein.

FIG. 8 illustrates the light can 100 being rotated axially. Side members 106-1, -2 are forced longitudinally and rotated axially to define a circle in the ceiling. The circle of ceiling material is cut completely therethrough by the side members 106-1, -2, forming a circular hole 134. As the side members 106-1, -2 cut through the ceiling material, the light can 100 is pushed inside the ceiling, pushing the cut-out circle piece 130 constrained by the central member 104 above the light can 100. Cutting debris 132 falls above the ceiling, rather than falling out through the circular hole 134 into the room.

The anchor threads 112 are shown beginning to engage the edges of the circular hole 134. As the light can 100 continues to rotate, these threads will screw into the hole and secure the light can 100.

Figure 9:
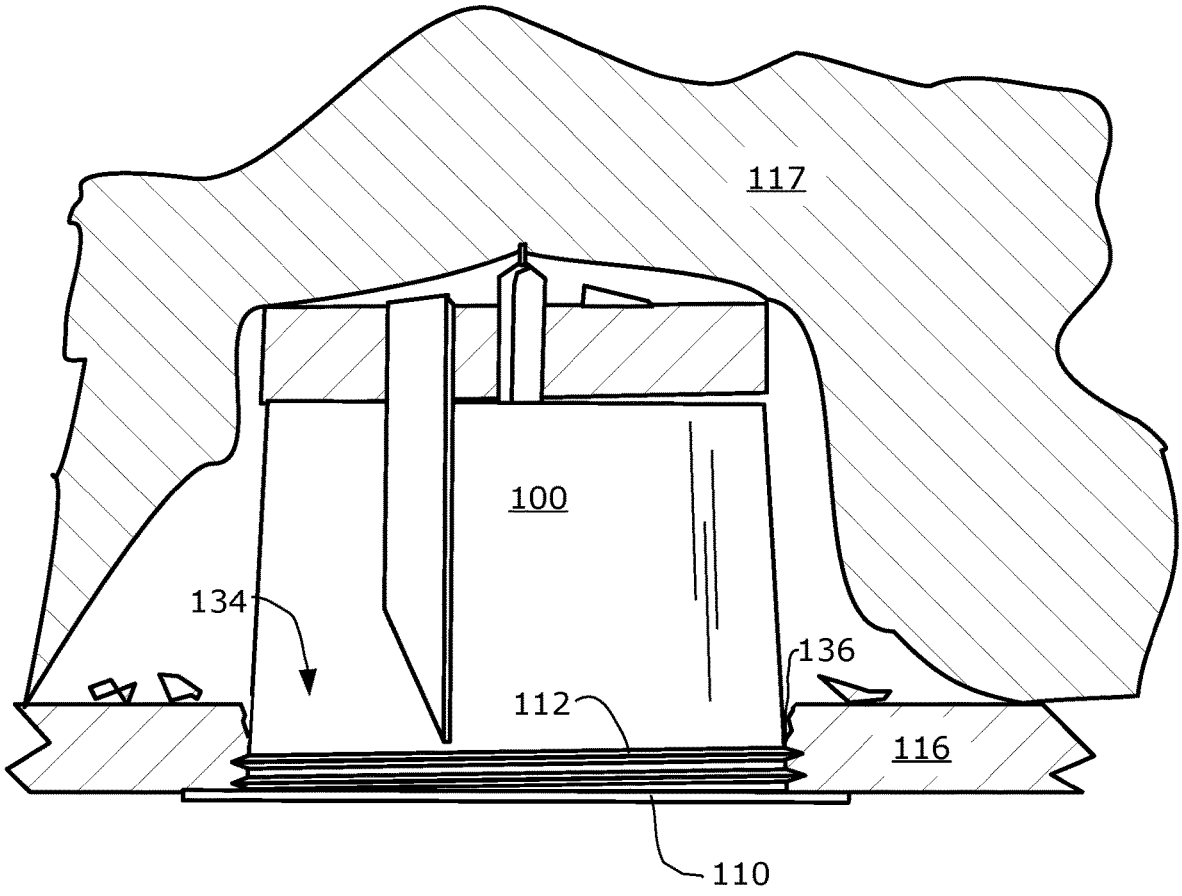
FIG. 9 is a cutout side view of a light can being assembled, according to an example of principles described herein.

FIG. 9 illustrates the light can 100 once the light can 100 is stopped from being pushed farther due to an annular ridge 110 at its base. The anchor threads 112 have fully engaged the edges 136 of the circular hole 134. At this point, rotation is stopped, and the driver is removed. The annular ridge 110 is a generally flat member that extends radially outward from the base of the sleeve 102. The annular ridge 110 extends past the edge of the ceiling 116 to create a flush contact with the ceiling 116. Insulation 117 (or other material) above the ceiling 116 is pushed up by the light can 100.

Figure 10:
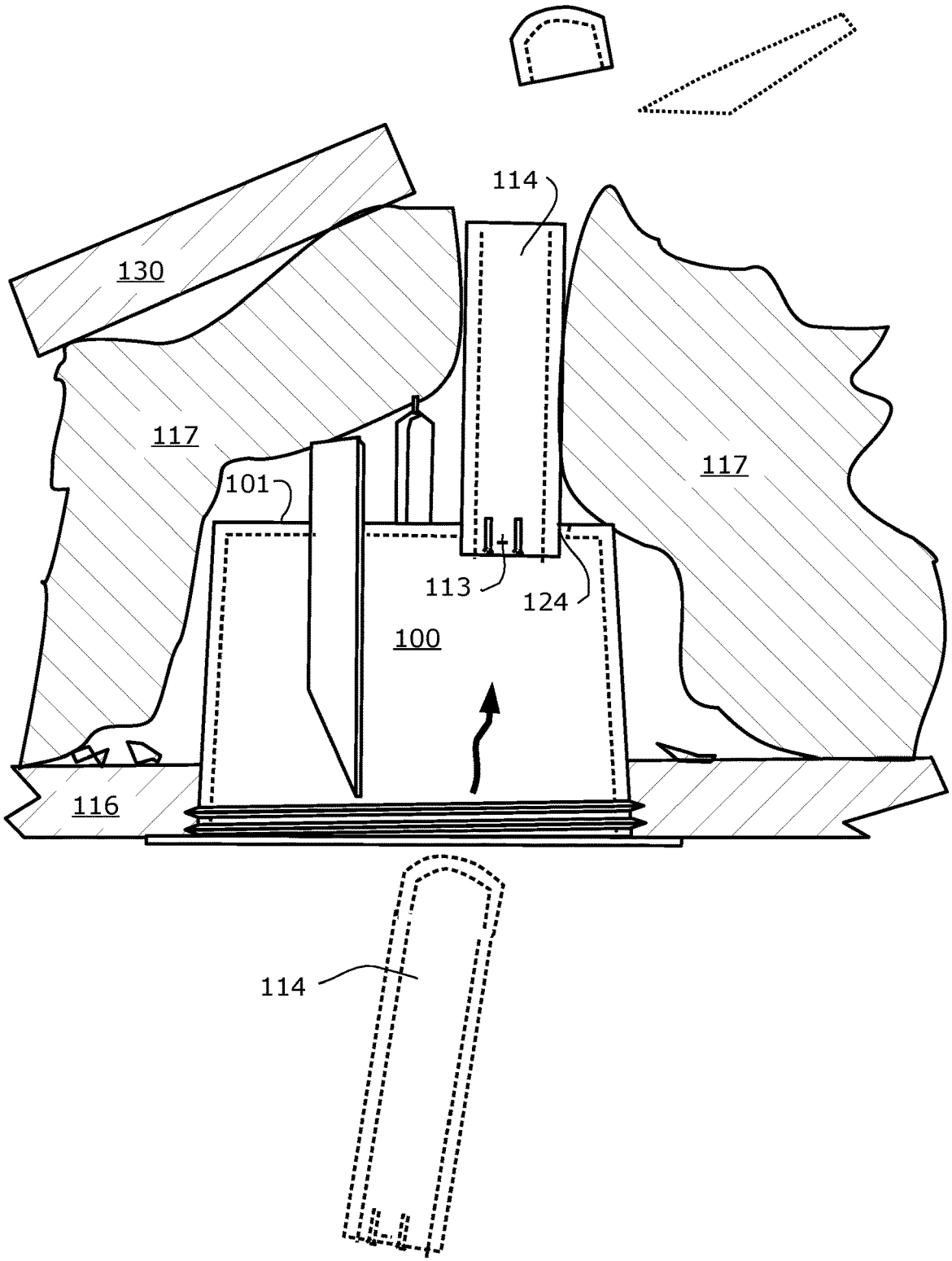
FIG. 10 is a cutout side view of a light can being assembled, according to an example of principles described herein.

FIG. 10 illustrates a snorkel extension 114 being inserted within the side opening 124. The snorkel extension 114 is a cylindrical member with a hollow therethrough that is dimensioned to be slidably inserted within the side opening 124. Before installation of the snorkel extension 114, the cut-out circle piece 130 is removed from the top 101. The snorkel extension 114 is then moved (see phantom) into the light can 100 and pushed inside the ceiling via the side opening 124. The snorkel extension 114 includes a latch 113, and/or annular ridge, and/or other suitable structure at its base to stop the snorkel extension 114 from being inserted past the top 101 of the light can 100. Once stopped, the snorkel extension 114 is secured within the side opening 124, which may be a latch 113, or by a threaded screw fit, or by a friction fit, or other suitable structure. A bonding material may also be used.

After the snorkel extension 114 is secured, the space above the ceiling is accessed, any insulation 117 cleared covering the top of tube, and the closed top 115 is cut off to open the top of the snorkel extension 114.

Figure 11:
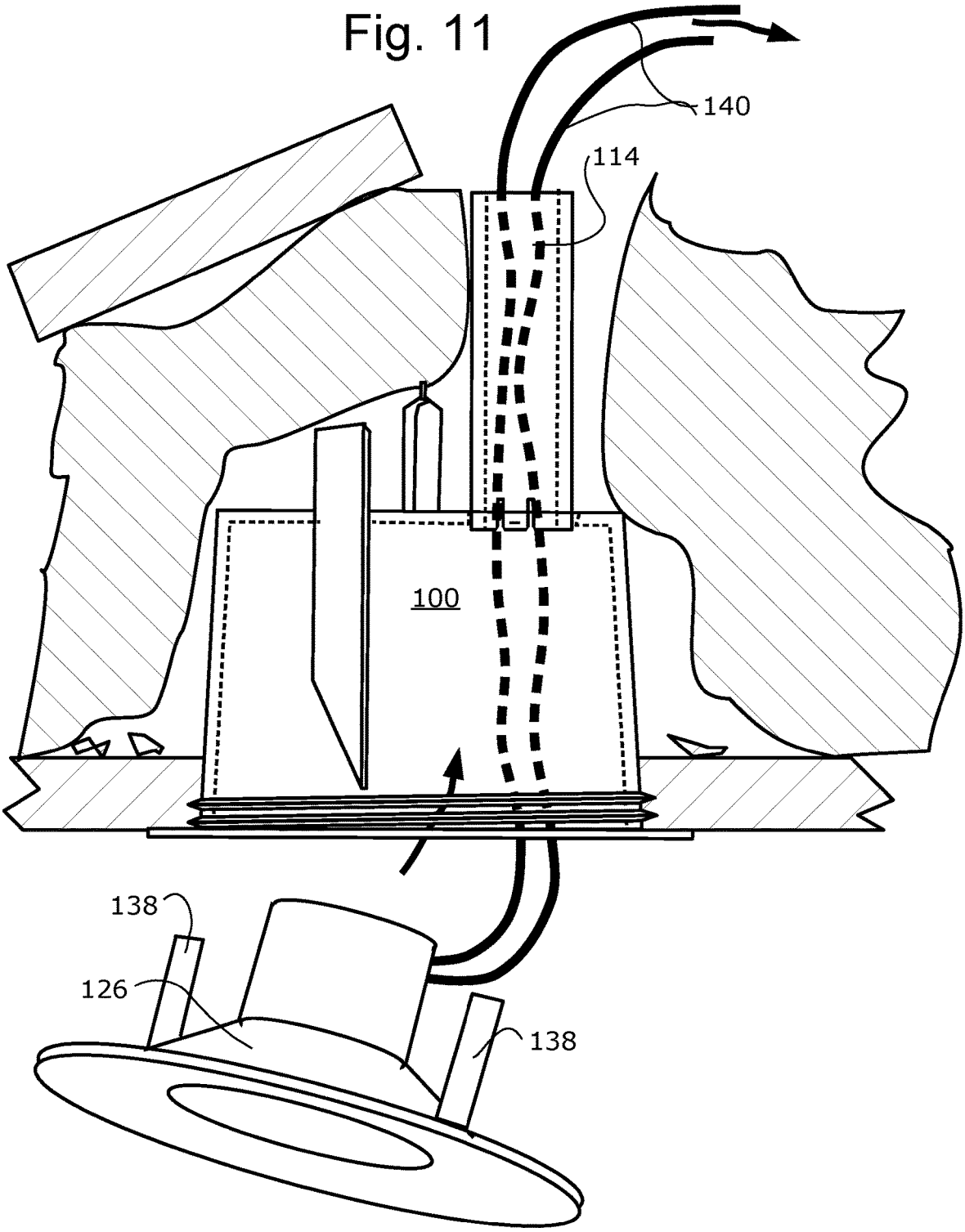
FIG. 11 is a cutout side view of a light can being assembled, according to an example of principles described herein.

FIG. 11 illustrates wires 140 that are inserted within the hollow opening of the snorkel extension 114 and passed through to an attic or other space above the ceiling. Also shown is a can light 126 that is inserted within the space of the light can 100. The can light 126 may be any commercially available light for insertion to can housings. These lights have spring tabs 138 or wires (or similar structures) that bear against the inner sides of the housing, such as the sleeve 102 shown, to secure the light in the housing. Wiring 140 of the light can 126 is passed up through the snorkel extension 114 to be attached to corresponding wiring near the end of the snorkel extension 114. Installation of lighting using the light can negates the need for a user to have a second hole in the ceiling to pass wires or the need to secure or clip wires into the ceiling.

Figure 12:
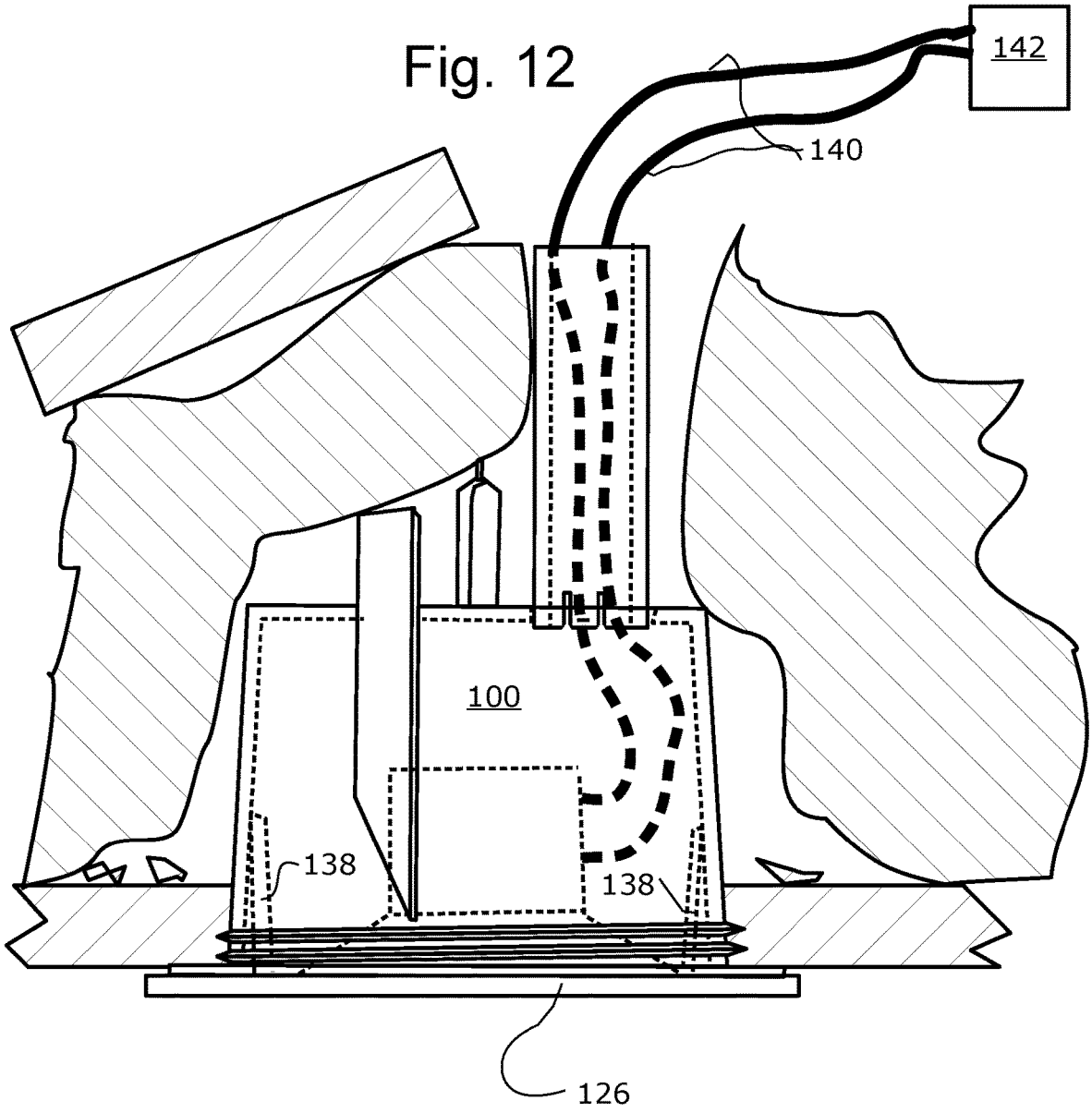
FIG. 12 is a cutout side view of a light can being assembled, according to an example of principles described herein.

FIG. 12 illustrates a completely installed light can 100 in a ceiling, with wiring 140 connected to an appropriate power source 142, and can light 126 secured by spring tabs 138. Outer facing sides of the can light 126 and light can 100 are essentially flush with the ceiling, creating a seamless flow to the ceiling surface.

The preceding description has been presented to illustrate and describe examples of the principles described. This description is not intended to be exhaustive or to limit these principles to any precise form disclosed. Many modifications and variations are possible in light of the above teaching.

What is claimed is:

1. A light can, comprising:

a sleeve that includes an elongate cylindrical member with rounded outer sidewalls;

a hollow within the sleeve;

two side members that extend co-axially along opposing sides of the sleeve and past a first end of the sleeve, each side member having an edge for cutting a surface; and an annular ridge at a second end of the sleeve, wherein the two opposing side members are to extend within a structural surface, the sleeve to be rotated axially with the edges of the two side members to cut a rounded hole within the surface, the sleeve to be inserted within the hole, and the annular ridge to stop the sleeve from further insertion of the sleeve within the surface.

2. The light can in claim 1, wherein the cutting edge of the two side members is tapered on a leading side for cutting.

3. The light can in claim 2, wherein the tapered cutting edge of the two side members is tapered at an acute angle.

4. The light can in claim 1, wherein free ends of the side members include pointed edges, the pointed edges to make initial cuts into the surface before rotating the light can into the surface.

5. The light can in claim 1, further comprising outer facing threads on the light can for engaging material beneath the surface.

6. The light can in claim 5, wherein the outer facing threads are located adjacent to the annular ridge.

7. The light can in claim 1, further comprising:

a top covering on the light can, the top covering covering a top end of the sleeve, and at least one hole in the top covering to route a wire through the top covering.

8. A light can, comprising:

a sleeve that includes an elongate cylindrical member with rounded outer sidewalls and a top covering;

a hollow within the sleeve;

a central member having a pointed head to cut into a surface;

a plurality of side members that extend co-axially along opposing sides of the sleeve and extend beyond a first end of the sleeve, each side member having an edge for cutting a surface when the sleeve is rotated within the surface so to define a circular cutout portion of the surface and allow the sleeve to be inserted within a material underneath the surface;

annular threads at or near a second end of the sleeve, the annular threads to allow a screw fit of the light can within the material underneath the surface, an annular ridge at a second end of the sleeve, the annular ridge to stop the sleeve from further insertion of the sleeve within the surface.

9. The light can in claim 8, further comprising:

a hexagon boss member centrally located underneath the top covering, the hexagon boss member to be engaged for axially rotating the light can.

10. The light can in claim 8, wherein the annular ridge includes a flat surface that faces outward from the second end of the sleeve, the flat surface to be parallel and appear flush with the surface when the light can is disposed within the material beneath the surface.

11. The light can in claim 8, wherein the central member extends beyond a height of the plurality of side members.

12. The light can in claim 8, wherein the extended members include a tapered edge such that is narrowed toward the cutting edge.

13. The light can in claim 8, wherein the extended members are blade-like members that have a curvature in conformance with the curvature of the sleeve.

14. The light can in claim 8, wherein the sleeve tapers inward from bottom to top.

15. A light can, comprising:

a sleeve that includes an elongate cylindrical member with rounded outer sidewalls;

a hollow within the sleeve;

a central member that extends outward from the sleeve, the central member having a pointed head to cut into a surface;

a plurality of side members that extend co-axially along opposing sides of the sleeve and extend beyond a first end of the sleeve, each side member having an edge for cutting into a a surface when the sleeve is rotated within the surface so to define a circular cutout portion of the surface and allow the sleeve to be inserted within a material underneath the surface;

annular threads at or near a second end of the sleeve, the annular threads to allow a screw fit of the light can within the material underneath the surface, an annular ridge at a second end of the sleeve, the annular ridge to stop the sleeve from further insertion of the sleeve within the surface.

16. The light can in claim 15, wherein the outer sidewalls of the sleeve are smooth.

17. The light can in claim 15, further comprising at least one indentation on an outer facing surface of each of the plurality of side members.

18. The light can in claim 15, further comprising an indentation on opposite sides of each extended member, each indentation running parallel to each other and coaxially to a central axis of the sleeve.

19. The light can in claim 15, wherein the plurality of side members are equally spaced around an outer surface of the sleeve.

20. The light can in claim 15, wherein the top surface is flat.

* * * * *